US007934457B2

(12) United States Patent
Brandt

(10) Patent No.: US 7,934,457 B2
(45) Date of Patent: May 3, 2011

(54) RAILCAR POSITIONING SYSTEM

(75) Inventor: Calvin J. Brandt, Delano, MN (US)

(73) Assignee: Calbrandt, Inc., Delano, MN (US)

( * ) Notice: Subject to any disclaimer, the term of this patent is extended or adjusted under 35 U.S.C. 154(b) by 1 day.

(21) Appl. No.: 12/422,468

(22) Filed: Apr. 13, 2009

(65) Prior Publication Data

US 2010/0258025 A1 Oct. 14, 2010

(51) Int. Cl.
*B61J 3/08* (2006.01)

(52) U.S. Cl. ..... 104/162; 104/172.3

(58) Field of Classification Search ..... 104/162, 104/163, 172.3
See application file for complete search history.

(56) References Cited

U.S. PATENT DOCUMENTS

| | | | | |
|---|---|---|---|---|
| 5,150,656 | A * | 9/1992 | Lobb et al. | 104/162 |
| 5,695,044 | A * | 12/1997 | Morikiyo et al. | 198/746 |
| 5,709,153 | A * | 1/1998 | Brandt | 104/162 |
| 6,006,673 | A * | 12/1999 | Brandt | 104/162 |
| 6,267,059 | B1 * | 7/2001 | Brandt | 104/162 |
| 6,389,984 | B2 * | 5/2002 | Brandt | 104/162 |
| 6,837,168 | B1 * | 1/2005 | Goldbeck et al. | 104/162 |
| 7,464,651 | B2 * | 12/2008 | Brandt | 104/162 |
| 2002/0007760 | A1 * | 1/2002 | Brandt | 104/182 |
| 2003/0010249 | A1 * | 1/2003 | Goldbeck | 104/162 |
| 2004/0194655 | A1 * | 10/2004 | Insana et al. | 104/162 |
| 2007/0251406 | A1 * | 11/2007 | Brandt | 104/27 |

* cited by examiner

*Primary Examiner* — S. Joseph Morano
*Assistant Examiner* — Jason C Smith
(74) *Attorney, Agent, or Firm* — Nikolai & Mersereau, P.A.; C. G. Mersereau

(57) ABSTRACT

A railcar positioning system operable as either an indexer or progressor is disclosed which includes a pair of spaced trackside railcar movers positioned outside and parallel to the rails of a railroad track. Each railcar mover includes a spaced trackside guideway located next to one of the railway rails, a plurality of spaced connected dog carriages mounted for operation together in the guideway, each dog carriage carrying a pusher dog mounted on the carriage, a reciprocating hydraulic cylinder associated with the plurality of spaced, connected dog carriages. A hydraulic power unit is connected to operate each of the cylinders individually or together and a control system is associated with the power unit for controlling the operation of the positioning system such that said positioning system may be optionally operated as an indexer or as a progressor.

13 Claims, 9 Drawing Sheets

RAILCAR POSITIONING SYSTEM

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

The present invention relates generally to trackside railway car handling equipment for positioning railcars along a track for loading or unloading operations. More particularly, the present invention relates to train positioning systems that are operable either as indexers or progressors and which operate against the bogey frames of rail cars.

II. Related Art

Freight-hauling railway cars need to be precisely positioned proximate freight or cargo handling equipment during loading and unloading operations. Freight in the form of bulk cargo such as grain is typically loaded or unloaded with reference to stationary freight handling equipment such as chutes and conveyor equipment situated at fixed locations above or in pits beneath a specific portion of the track. Railcars for transporting grain or other such finely divided dry bulk agricultural commodities may be covered and designed with a plurality of spaced bottom discharge hopper bins or chutes accessing the main cargo storage volume. The chutes are closed by capstan-operated rack and pinion bottom closure gate systems.

In the loading and discharge operations, a connected engine roughly positions one end of a string of cars to be loaded or unloaded beneath or above the appropriate equipment at the desired fixed location. Because locomotives are not well suited for precisely positioning individual cars or even strings of cars along a railroad track, positioning devices known as train movers or positioners are located at fixed stations along the track. The positioning devices generally employ heavy pushing members known as railcar-engaging "dogs" to move the cars into position.

Positioning devices are generally classified in the industry as "indexers" or "progressors". Indexers may employ dogs carried by a pair of carriages operating along indexer tracks on built-in guideways located on opposite sides of associated track rails. Indexers are designed so that the carriages and associate dogs on both sides of the track are coordinated to operate together in unison to engage and move a car or string of cars along the track. Thus, in indexer type bogey frame-engaging positioning devices, both dogs of a pair of dogs spaced on opposite sides of the track are caused to engage the bogey frame during the same stroke to thereby provide a balanced force by pushing against both of the spaced sides of the truck bogey frame simultaneously.

Progressors designed to operate against bogey frames also operate along rails in built-in guideways on the outside of each of the spaced rails of a track with dogs that operate along each of the guideways spaced along the track. Rather than operating simultaneously against both sides of a bogey frame to move a car or string of cars, the dogs of a progressor are operated alternately, to sequentially engage a bogey frame so as to "hand off" the car or string of cars alternating between dogs on opposed sides of the track.

Using either type system an entire string of connected cars may be advanced with precision and loaded or unloaded, one car at a time. As with the indexer system, the progressor can be stopped at any point in the operating cycle when the desired position is reached.

Operation of car handling equipment in each of the modes described above has certain advantages and either may be desirable depending on operational circumstances and conditions. As indicated, operation as an indexer advantageously provides a balanced side-to-side force on the bogey frame and enables the total force of two dog carriage systems to be applied at once so that heavier loads may be moved. This also enables a balanced force to be applied against the bogey frames of lightly loaded cars which avoids a possible tipping situation which may occur when force is applied to one side only. However, because indexers operate the dogs together, after a power stroke, both dogs must be retracted and the next bogey frame found before the next power stroke can be started. Operating both dogs together on the power stroke necessarily slows the speed of progression. Progressor type operation can provide multiple power strokes in rapid succession by alternating carriage operation in a hand-off fashion, however, the applied force is limited to that of a single dog carriage and the force of that dog is operated against only one side of the bogey frame.

Heretofore, such railcar handling equipment has been constructed as dedicated to operation either as an indexer or a progressor and it would provide a distinct advantage and answer a definite need in the art if such a system could handle railcars in either manner.

SUMMARY OF THE INVENTION

By means of the present invention there is provided a railcar positioning system operable either in an indexing mode or as a progressor. The system includes left and right track side indexing or railcar-moving arrangements positioned just outside and parallel to flanking the rails of a conventional railroad track. Each of the left and right track side arrangements includes a guideway which extends along the track and carries a plurality of spaced sequentially connected dog carriages mounted for operation in the guideway, each dog carriage is provided with a vertically pivoting pusher dog mounted on the carriage. Each arrangement is operated by a double-acting hydraulic cylinder which is designed to reciprocally move the arrangement including the several sequential dog carriages, either in an extend or retract direction. Each of the tracking arrangements also includes its own hydraulic power unit and each of the operating cylinders is provided with an individual, separately operable control and valving system including multi-position hydraulic control valve which enables individual, separate operation. The control and valving systems are also integrated to provide coordinated action between the two hydraulic cylinders such that the combined system may be operated as an indexer or as a progressor.

In one illustrative embodiment, each of the car-moving arrangements includes three dog carriages sequentially spaced by connecting rods. Each dog carriage rides on a rail and carries a dog that is spring-biased in the raised position and each guideway includes downing devices for automatically downing and latching devices for automatically latching all three dogs when each cylinder is fully extended. The dogs are downed using cam-operated ramping systems and spring-biased latching mechanisms which capture latch wheels attached to the dogs. Thus, each dog carriage latch mechanism has a pivoting spring-operated catch device that captures an associated latch wheel attached to a corresponding dog. The cylinders can be fully retracted with the dogs locked down. Dog carriage latch tripper flags are provided that pivot the catches and open the latches and allow the dogs to pop up when the carriages are advanced from the fully retracted position.

In the detailed embodiment, the dogs utilized are vertically operating low dogs which push against a lower portion of the sides of the bogey frames of cars being moved by the positioning system of the invention.

BRIEF DESCRIPTION OF THE DRAWINGS

In the drawings wherein like numerals are utilized to designate like parts throughout the same.

DETAILED DESCRIPTION

The following detailed description of the present invention describes the invention in terms of being a versatile system able to move railcars in either of two modes, i.e., as an indexing system by operating the dogs on either side of the track in pairs to push against opposite sides of a common bogey frame in unison or, alternatively, to have the system operate sequentially as a progressor to provide continuous motion using right and left dogs to push against one and then the other side of a bogey frame in a hand-off mode. In either mode, the system may be stopped anywhere in the operating cycle to allow loading or unloading operations to take place. It will be understood that the system described is intended to present a example of the inventive concept and is not intended to limit the scope of the invention in any manner as variations within the scope of the inventive concept may occur to those skilled in the art.

Figure 1:
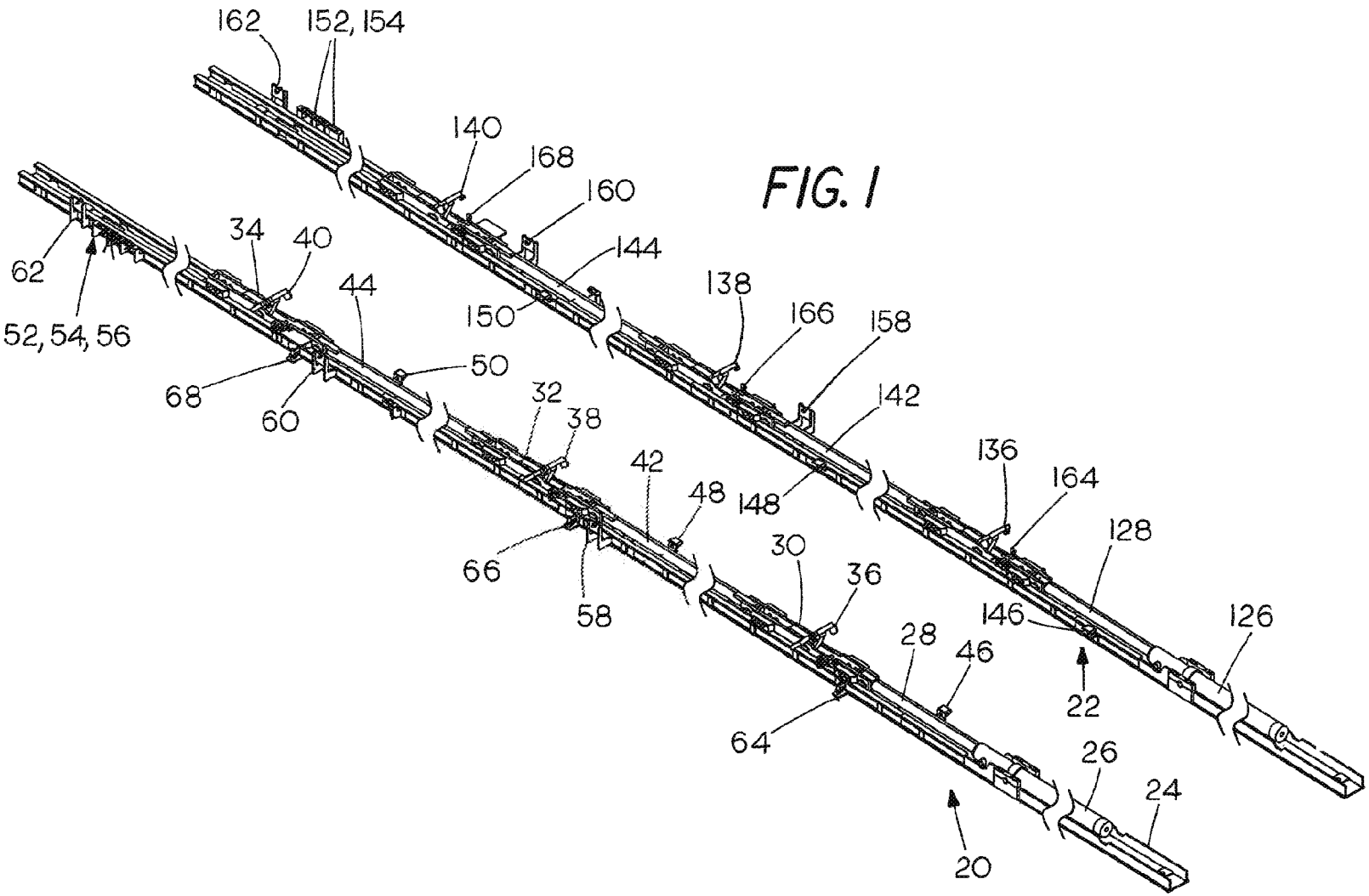
FIG. 1 is a schematic perspective fragmentary view of a pair of spaced left and right railcar indexing arrangements in accordance with the invention with parts broken for convenience.
Figure 2:
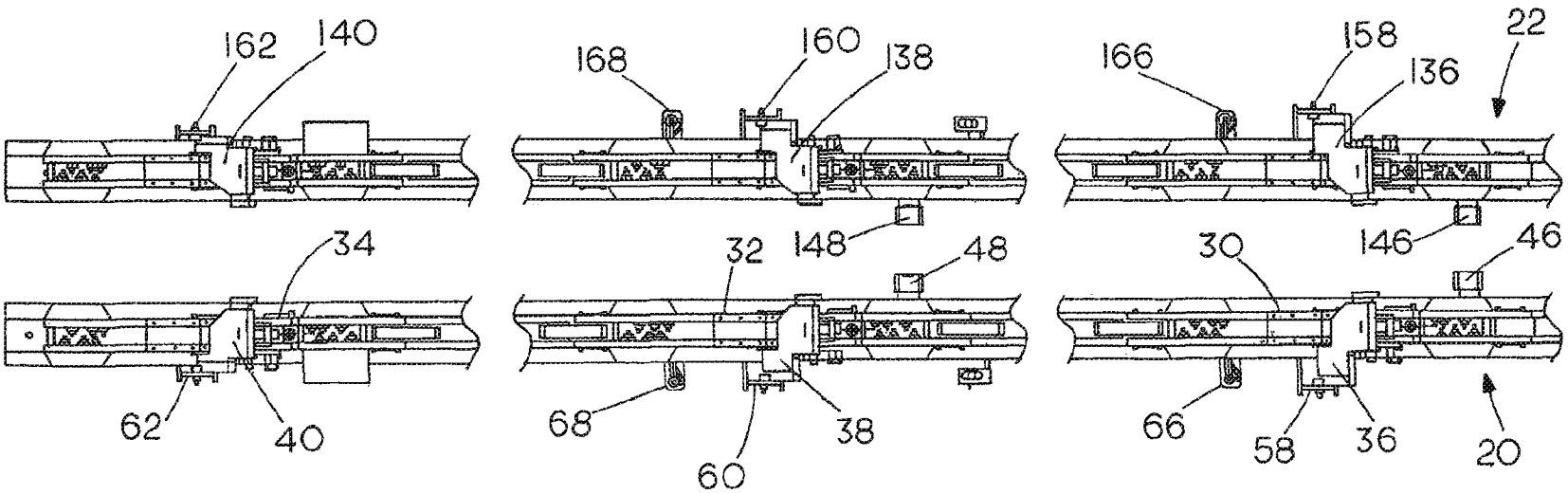
FIG. 2 is a slightly enlarged partial top view of the arrangement of FIG. 1.

FIGS. 1 and 2 depict schematic perspective views, with parts broken for convenience, of left and right railcar indexing arrangements of a train positioning system in accordance with the invention. The system includes spaced left and right train moving or indexing arrangements 20 and 22, respectively, which are positioned just outside and parallel to a pair of railroad tracks (not shown) in a well known manner so that one car-moving arrangement is located just outside each rail. The left and right indexing arrangements are generally identical opposed systems which may be slightly offset from each other. The left positioner 20 includes an elongated guideway or indexer track at 24 (shown in broken segments for clarity and convenience) which houses the components of a railcar-moving indexer system designed to operate reciprocally along the guideway 24. The components of the railcar-moving arrangement include left hydraulic cylinder 26 with associated rod 28. Three spaced dog carriages are provided including a cylinder carriage 30, a mid carriage 32 and an end carriage 34, which carry vertically pivoting low dog pushing devices shown at 36, 38 and 40, respectively. The dog carriages are connected at fixed spacings by mechanical linkages and connecting rods as at 42 and 44 in a well known manner. The dog carriage 36 is connected to the cylinder rod 28.

The dogs are spring-biased to a raised or pushing position and must be forced or pushed down to be lowered. Devices are provided to automatically lower and retain the corresponding dogs in a lowered or dropped position under certain circumstances. These include a latch on each dog carriage associated with a latch wheel and a cam operated mechanical arrangement which ramps an associate dog down. An associated dog latch tripper flag is provided to unlatch the dog, as will be described.

The indexer further includes dog down proximity sensors 46, 48, 50, one associated with each dog carriage travel space. The end of the left indexer further includes a full extend dog lock down and hand off proximity sensors at 52, 54, 56.

Dog ramp down devices are shown at 58, 60, 62 and dog tripper flags are shown at 64, 66, 68. The operation of these devices will be explained. A full retract proximity sensor is included at 70.

The right indexer 22 is positioned in spaced parallel relation to the left indexer and is of like design so that it is generally an opposed or mirror image of the left indexer. It includes a right hydraulic cylinder 126 with rod 128. Right indexer dog carriages are likewise shown successively at 130, 132, 134 carrying respective dogs 136, 138, 140 with carriage connectors shown at 142, 144. The right indexer has corresponding dog down proximity sensors 146, 148, 150 and full extend and dog lock down proximity sensors 152, 154. Dog ramp down devices are shown at 158, 160, 162 and corresponding tripper flags 164, 166, 168.

Figure 3:
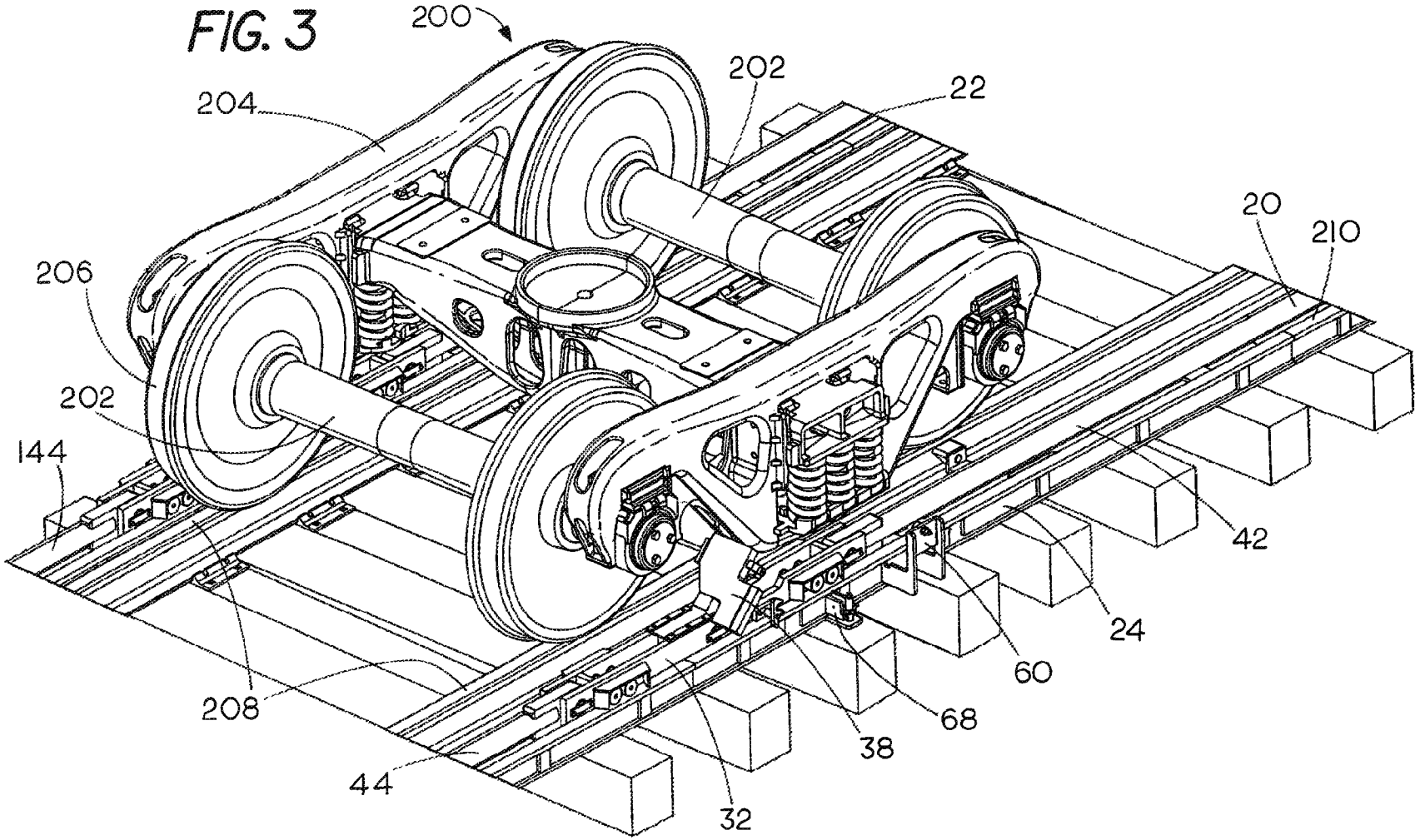
FIG. 3 is a greatly enlarged fragmentary view showing a low dog addressing a bogey frame of a railcar truck.

FIG. 3 depicts a railcar truck carriage, generally 200 including a pair of spaced axels journaled in a bogey frame 204. Flanged wheels 206 ride on spaced rails 208. A raised low dog 38 is shown addressing bogey frame 204 from dog carriage 32 as it rides on carriage indexer track 210.

Figure 4A:
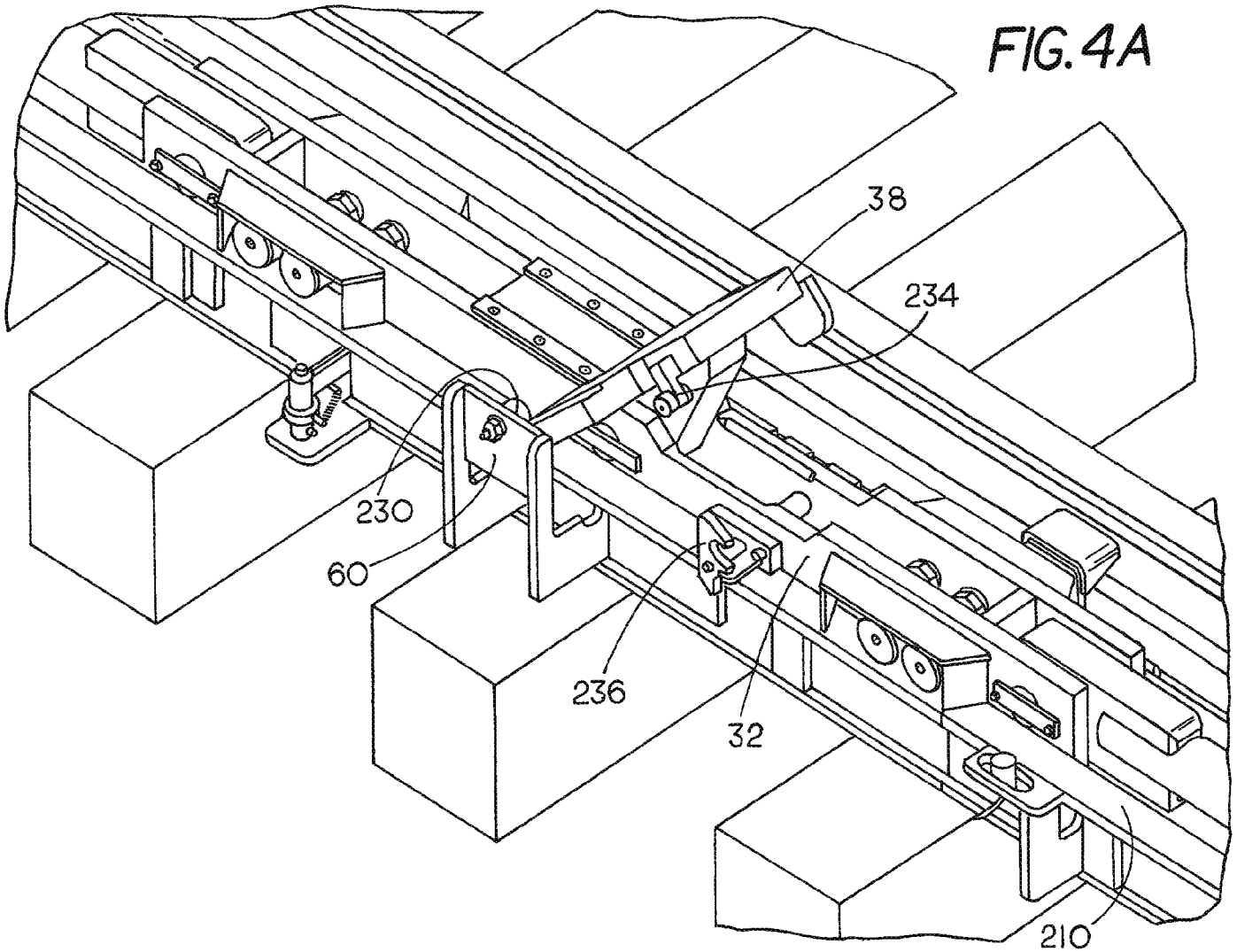
FIG. 4A is a greatly enlarged fragmentary view of a dog carriage showing a dog in a raised position.
Figure 4B:
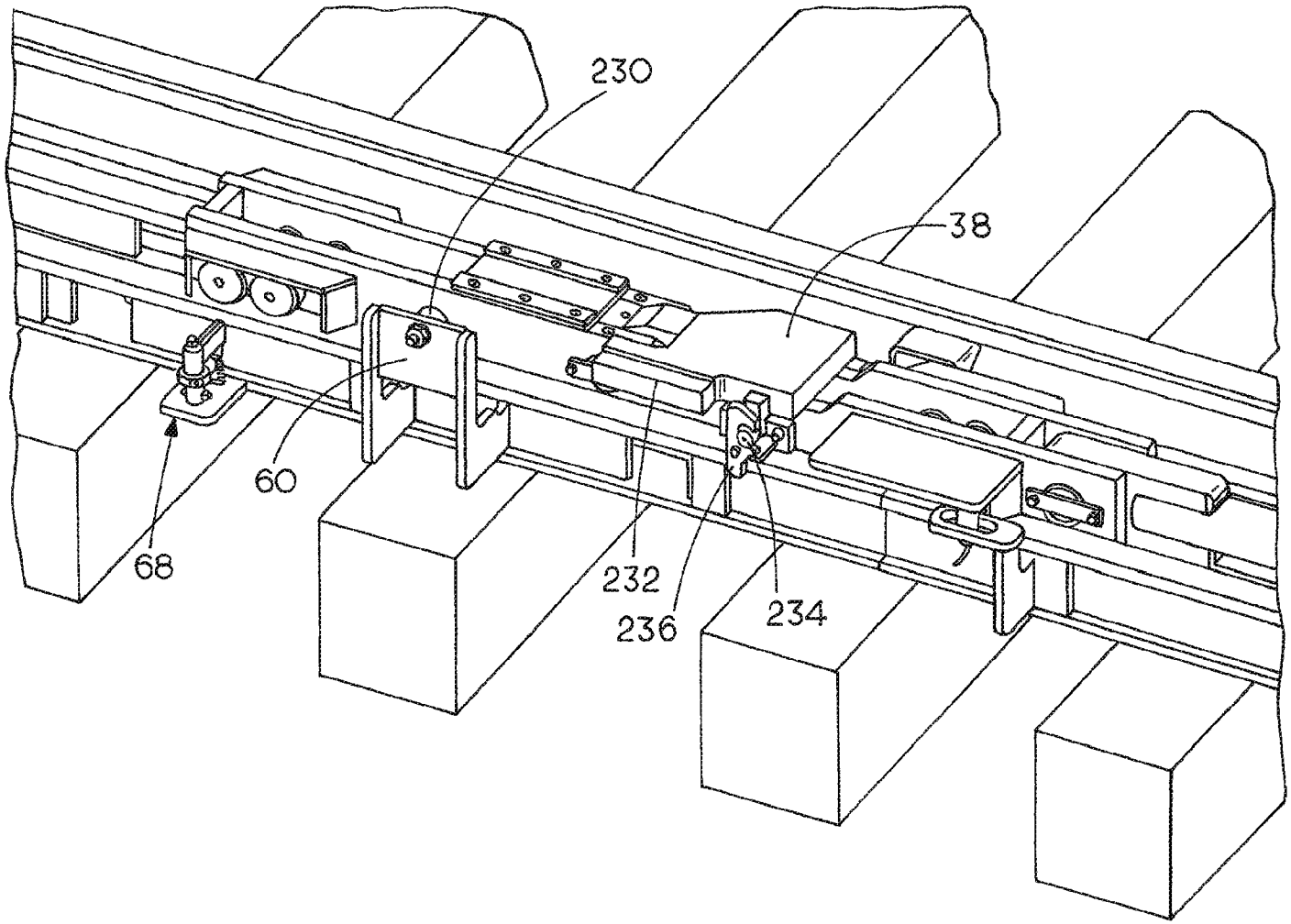
FIG. 4B is a view similar to FIG. 4A showing the dog in a downed, latched position.

FIGS. 4A and 4B depict greatly enlarged fragmentary views showing a dog in the raised and downed, latched position, respectively. The dog 38 is maintained in a raised position by a tension spring (not shown) unless forced down, as will be explained. In the figures, a dog ramp down device 60 and a dog latch device 220 cooperate to lower and latch the dog 38.

The ramp down device 60 includes a ramp down cam wheel 230 which is disposed to contact a follower extension 232 which is designed to contact an associated ramp down cam wheel. The dog 38 further includes an attached lock down or latch wheel 234 which cooperates with a spring-operated dog latch member 236 to latch the downed dog in the lowered position, as shown in FIG. 4B. A dog tripper flag 68 is also shown, which operates to release the latch on the next consecutive dog.

Figure 5:
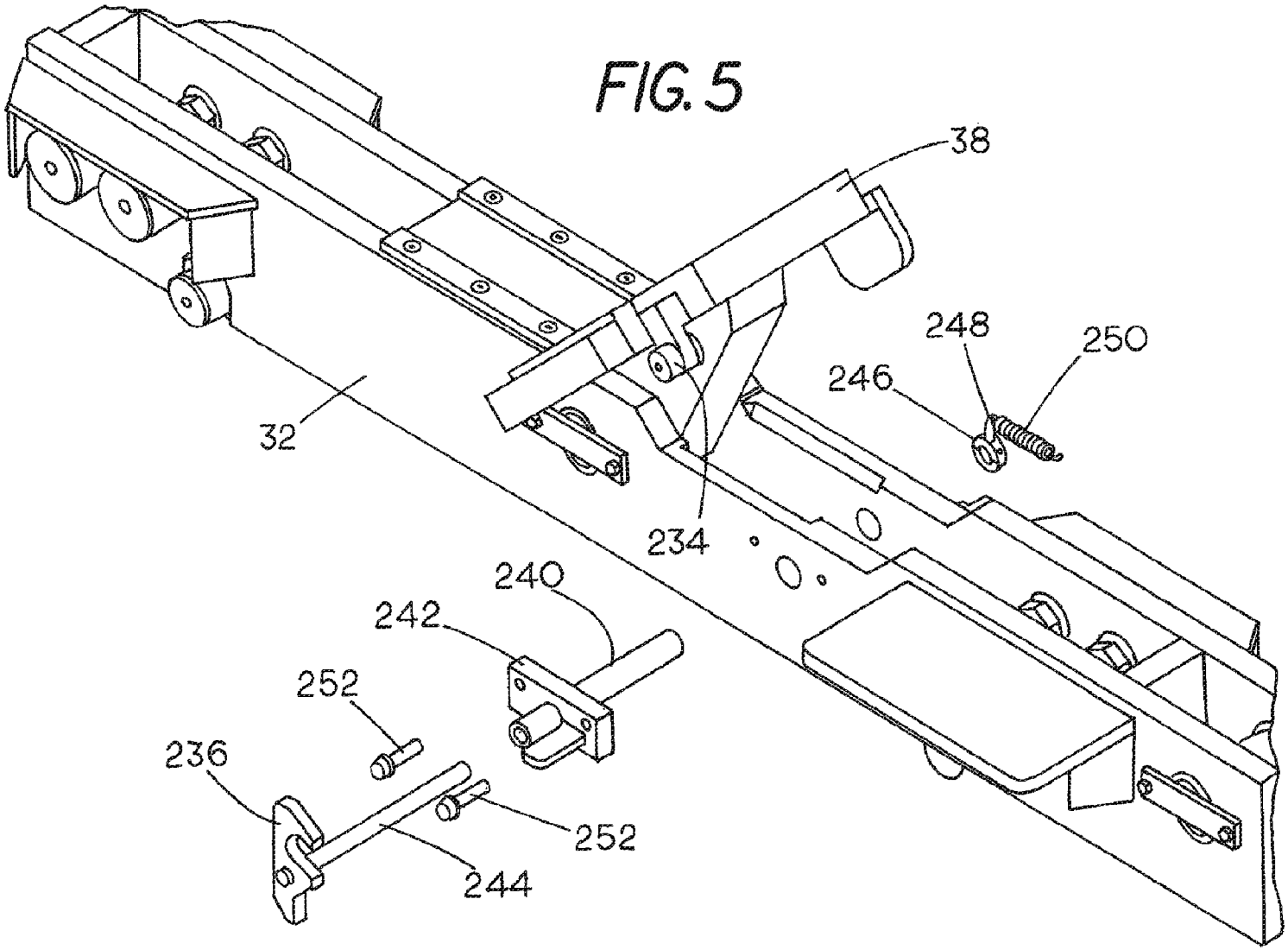
FIG. 5 is a greatly enlarged fragmentary view of a dog carriage showing a latch assembly exploded.

FIG. 5 depicts a greatly enlarged exploded view of a latch assembly for a dog latch member 236 that includes a tube 246 with attached mounting bracket 242, a latch shaft 244 and shaft collar 246 which is keyed to shaft 244 and includes attached lever 248 and biasing tension spring 250. The spring 250 puts rotational torque on the shaft 244 to maintain the dog latch member 236 in the upright or latched position. The latch assembly is fixed to the dog carriage by fasteners 252.

Figure 6:
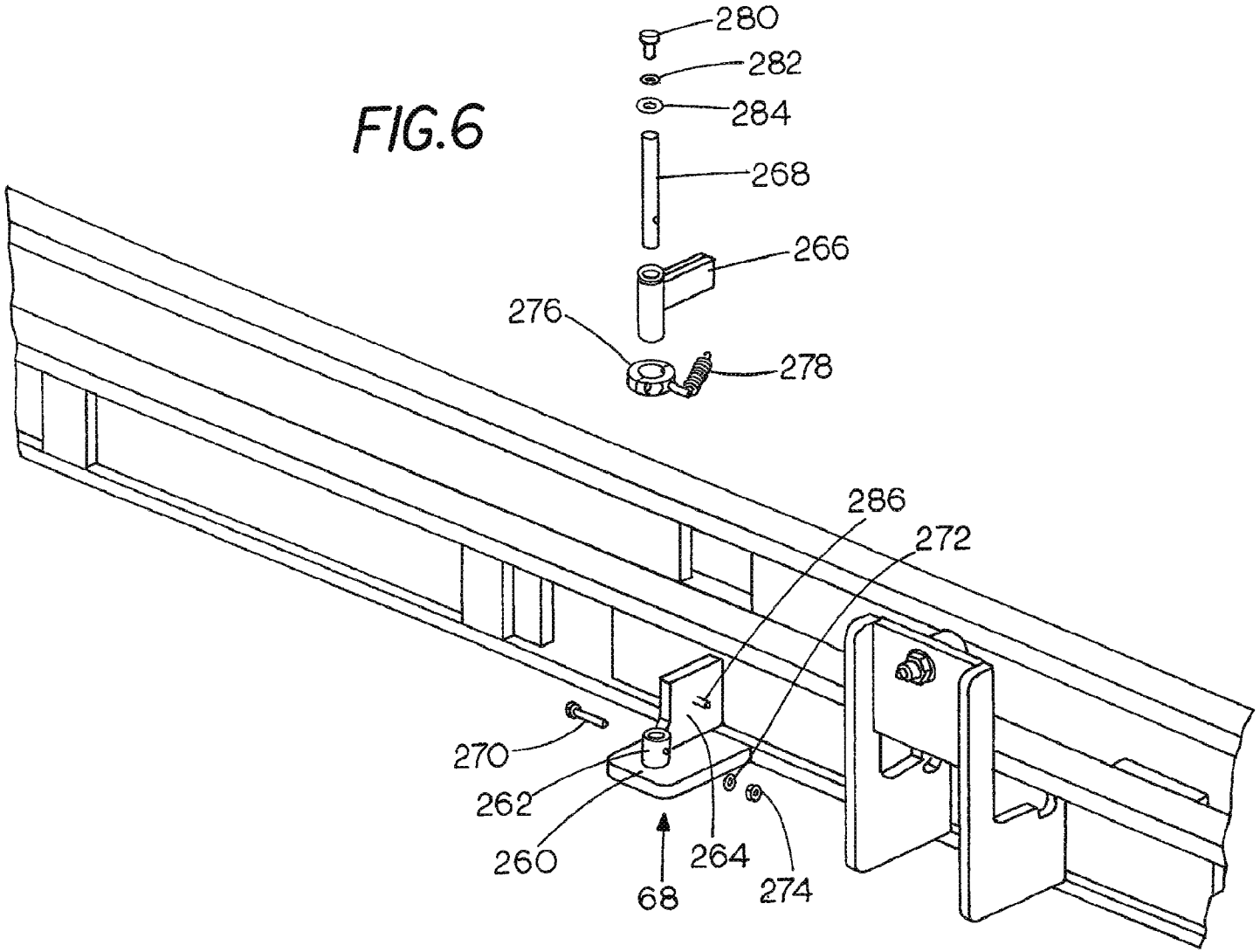
FIG. 6 is a greatly enlarged fragmentary view of a part of a guideway showing an exploded view of a dog latch tripper flag.

A dog tripper flag assembly as at 68 is shown exploded in FIG. 6 and includes a base member 260 with base tube 262 and gusset member 264. A tube mounted flag member is provided at 266 with mounting shaft 268 that is carried in base tube 262 by bolt 270 with washer 272 and nut 274. A spring-biased collar is provided at 276 with tension spring 278 and a bolt. Washers are provided at 280, 282, 284. As assembled, the spring 278 is fastened between the gusset 264 at 286 and the collar 276. In this manner, a dog latch member as at 236 passing a latch tripper flag during a cylinder extension will encounter the resistance produced by the tripper flag spring and will pivot the corresponding dog latch member counter-clockwise, opening the latch, releasing the dog latch wheel thereby allowing the related dog to pop up. A latch member encountering a latch tripper flag during a retraction stroke will push the flag aside and the dog will remain latched.

Figure 7A:
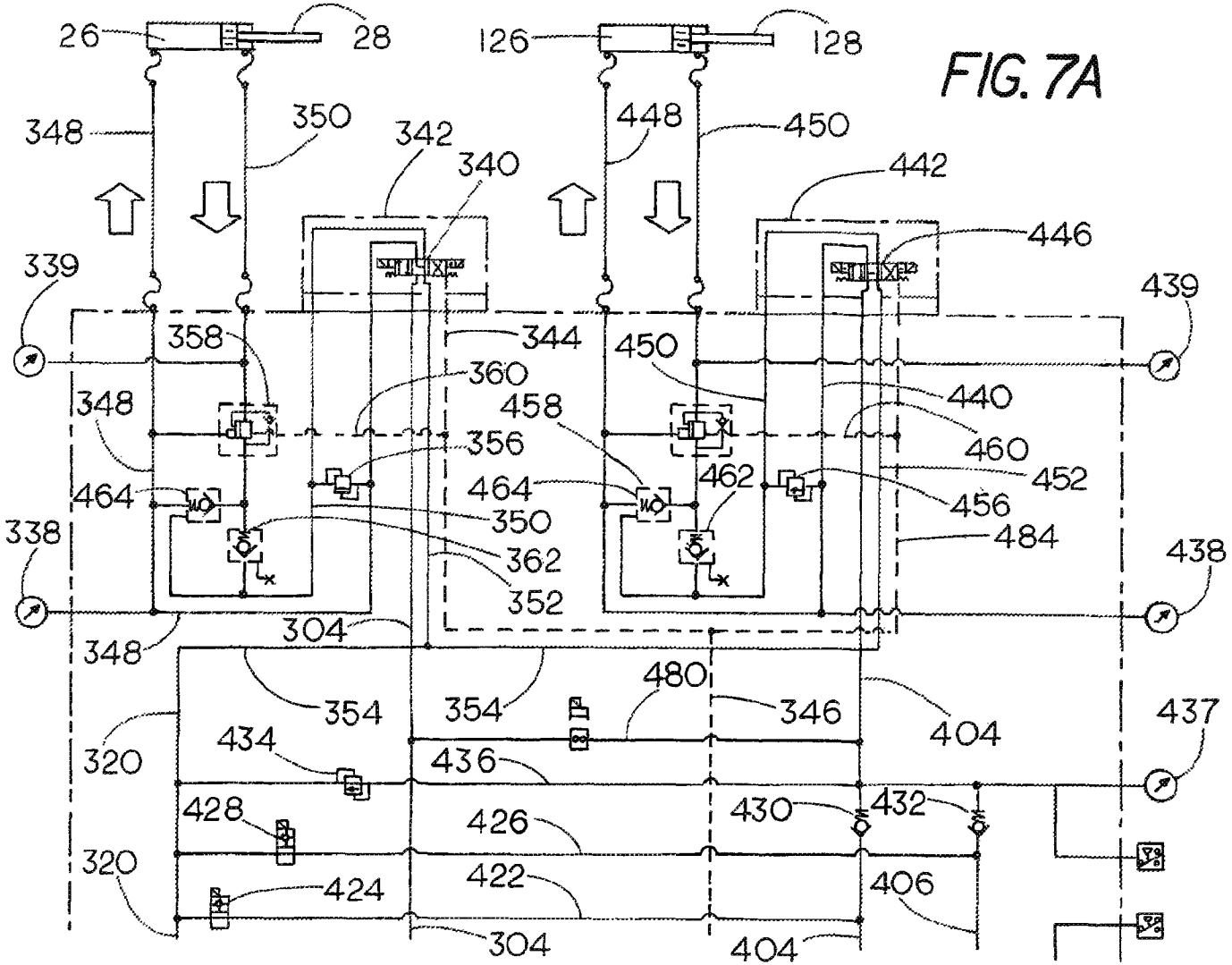
FIGS. 7A and 7B depict a typical hydraulic diagram of a control system suitable for use with the system of FIGS. 1-6.
Figure 7B:
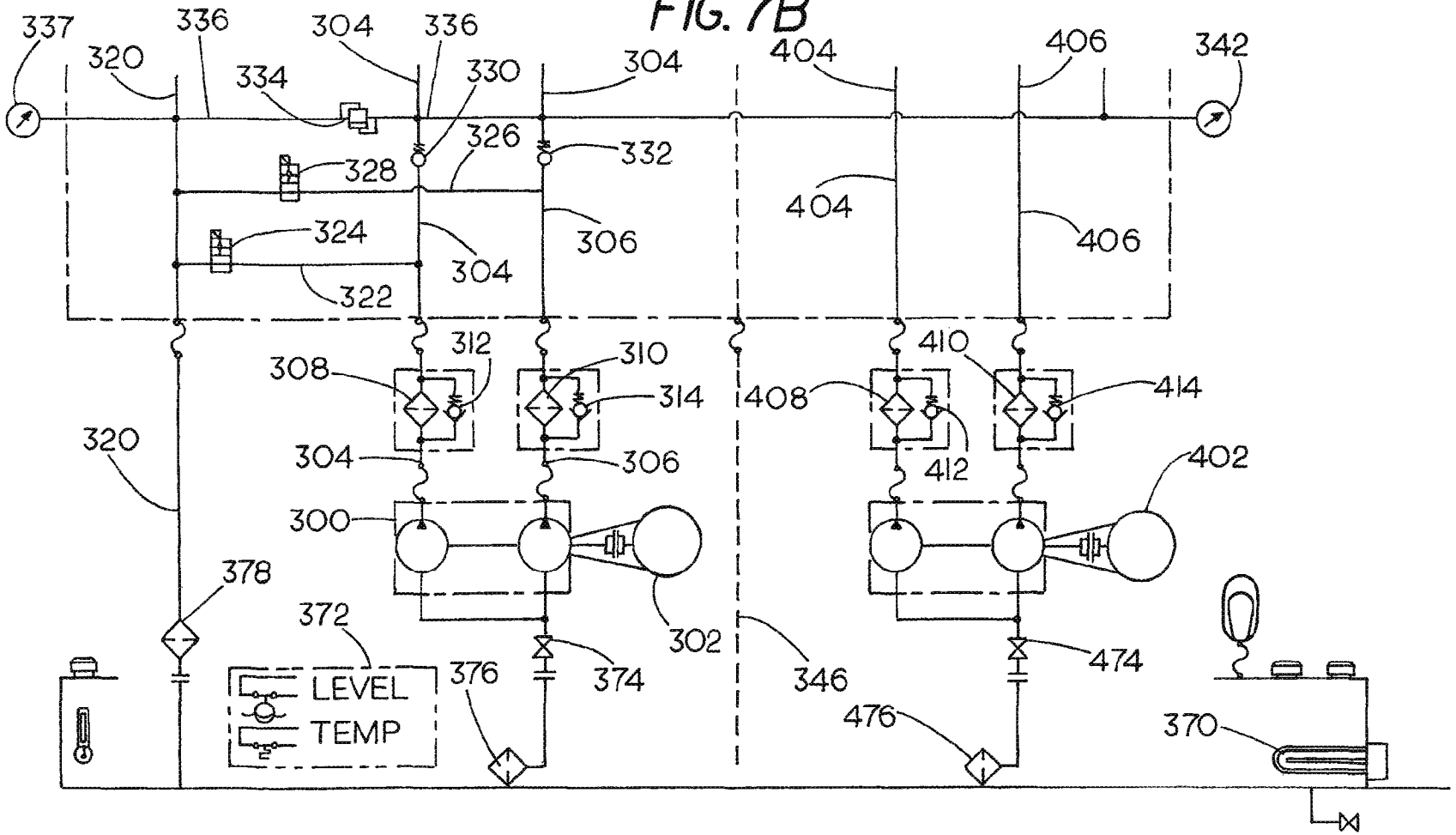

FIGS. 7A and 7B depict a diagram of a hydraulic system suitable for operating the railway car handling system of the invention. The hydraulic system includes separate hydraulic power systems for the left and right indexer arrangements which enable them to operate separately or together. The left indexer system includes a hydraulic pump system 300 operated by a motor 302. The pump system has outlet connections to high pressure feed lines 304 and 306 which include in-line filters 308, 310 with check valve by-pass line filters 312, 314; respectively. Connection to a return or drain line 320 for lines 304*m*, 306 are shown and include line 322 controlled by drain solenoid valve 324 and line 326 controlled by solenoid drain valve 328. Check valves are located at 330, 332 and a general dump drain valve for both lines is shown at 334 on line 336 with associated pressure gauge 337. An additional pressure gauge is shown at 338, 339.

The operation of the left indexer cylinder 26 is controlled by three-positioned valve 340 within the dashed line at 342. Valve 340 includes an internal drain to dashed drain line 344 which connects with a common drain line 346. Valve 340 has extend, neutral and return positions and connects high pressure line 304/306 with an extend line 348 and retract line 350 which, in turn, connect with cylinder 26 at the blind and rod ends, respectively. As return or drain line is shown at 352 which connects the valve 340 with return line 320 via line 354. The system further includes over pressure relief valves 356 and 358, the latter of which also has an internal drain connection to line 360. Check valves are incorporated at 362, 364.

The hydraulic supply system further includes an electric hydraulic oil heater 370, operated by a temperature switch shown in the box at 372 along with a hydraulic sump liquid level switch 373 and a left system shutoff valve is shown at 374 and a suction or inlet filter is shown at 376. A filter is shown in return line 320 at 378.

Similarly, the right indexer system includes a pumping system 400 operated by connected motor 402. Pump high pressure outlet lines are shown at 404, 406. Inline filters are shown at 408, 410 with respective spring-loaded bypass check valves 412, 414. Connections to drain line 320 for lines 404, 406 include line 322 with solenoid drain valve 424 connected to high pressure line 404 and line 426 with solenoid drain line 428 connected to line 406. Check valves are located at 430, 432 and a general dumper drain valve for both lines is shown at 434 on line 436, which is also connected to a pressure gauge 437. Other pressure gauges are shown at 438, 439.

The operation of right indexer cylinder 126 is controlled in the same fashion as left cylinder 26 and the system includes a 3-position valve 440 in dashed lines 442 with an internal drain to line 444 which also connects to a common drain line 346. The 3-position valve also connects high pressure line 404/406 with extend line 448 and a retract line 450 which connect to respective blind and rod end ports of the cylinder 126. As return or drain line is shown at 452 which connects with the common drain lines 354, 320. The system also includes over pressure relief valves 456, 458. Valve 458 includes drain line 460 and check valves are shown at 462, 464. A right system shut-off valve is shown at 474 with corresponding intake filter 476.

A common connecting high pressure line is shown at 480 to balance the pressure between the lines 304 and 404 when the cylinders are operated together.

In operation, the system is started with the cylinders fully retracted and the dogs latched down. When the system is activated, both cylinders are extended and the corresponding dog latch tripper flags are encountered by corresponding latch members which cause the latch members to rotate and release the dog latch wheels and allow all of the dogs to pop up. When an advancing dog encounters, is pushed down by, moves behind, and pops up behind a bogey frame, that corresponding indexer may be used to move the car or string of cars as a progressor and haul off to the next dog in the opposite indexer, etc. in a well-known manner or the other indexer can continue to extend until both opposite dogs encounter are pushed down by and pop up behind the same bogey frame and the system is operated as an indexer.

It should be apparent that the power stroke, in any event, occurs when the cylinders are in the retraction mode only and accordingly, the retract mode is operated at a much higher, possibly 2400 psi pressure vs possibly 850 psi for an extend stroke.

Of course, the diameter, and thus the area, of the cylinders and rods, along with the operating pressure, will determine the total force applied or available for an extend or retract stroke.

In the event that the force necessary to move a car or string of cars in the progressor mode exceeds the safe level for a low dog against one side of a bogey frame, the system may require switching to an indexing mode where twice the pulling force is available using dogs from both left and right indexers against the bogey frame. This also balances the force against the bogey frame preventing any tendency of a corresponding truck to derail.

The left and right indexers also may be offset by a small distance to compensate for any showing of any encountered truck bogey frames which shift due to a progressor dog pushing against one side of the frame alone.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A railcar positioning system comprising:

(a) a pair of spaced, trackside railcar-moving arrangements positioned outside and parallel to the rails of a railroad track, each said railcar-moving arrangement further comprising:

(1) a spaced trackside guideway located next to one of the railway rails, (2) a plurality of spaced, connected dog carriages mounted for operation together in said guideway, each dog carriage carrying a pusher dog mounted on said carriage, (3) a dog carriage moving device consisting of a single reciprocating hydraulic cylinder associated with each of said pair of spaced, trackside railcar-moving arrangements for moving said plurality of spaced, connected dog carriages, (b) a hydraulic power unit connected to operate each of said cylinders optionally individually or together; and (c) a control system associated with said power unit for controlling the operation of said positioning system such that said positioning system may be optionally operated both as an indexer and as a progressor.

2. A railcar positioning system as in claim 1 wherein each said dogs are spring-biased to a raised position, and wherein said trackside guideway includes downing devices that contact and automatically down corresponding dogs when said single reciprocating hydraulic cylinder is fully extended such that said dogs encounter said downing devices.

3. A railcar positioning system as in claim 2 wherein each said downing device includes a cam-operated ramping system.

4. A railcar positioning system as in claim 3 wherein said downing device includes a cam which operates against a surface on the dog.

5. A railcar positioning system as in claim 4 including a latching device mounted on each said dog carriage for latching the dog of that carriage in a downed position when the dog is downed.

6. A railcar positioning system as in claim 2 including a latching device mounted on each said dog carriage for latching the dog of that carriage in a downed position when the dog is downed.

7. A railcar positioning system as in claim 6 wherein each dog includes an attached latch wheel and each of said latching devices further includes a pivoting spring-operated catch device that captures an associated latch wheel attached to the dog mounted on that carriage.

8. A railcar positioning system as in claim 7 further comprising a dog latch tripper flag on said guideway associated with the travel of each dog to unlatch a corresponding dog as the corresponding hydraulic cylinder is extended.

9. A railcar positioning system as in claim 7 wherein said latching device further a pivoting spring-operated catch device that captures an associated wheel attached to the dog mounted on that carriage.

10. A railcar positioning system as in claim 9 further comprising a dog latch tripper flag on said guideway associated with the travel of each dog to unlatch a corresponding dog as the corresponding hydraulic cylinder is extended.

11. A railcar positioning system as in claim 1 wherein said control system associated with said power unit further comprises a three-position valve for operating each said hydraulic cylinder.

12. A railcar positioning system as in claim 1 wherein said dogs are low dogs.

13. A railcar positioning system as in claim 1 comprising three dog carriages in each guideway.

* * * * *